United States Patent [19]

Sorokan

[11] Patent Number: 4,831,795

[45] Date of Patent: May 23, 1989

[54] DRILLING DERRICK ASSEMBLY

[76] Inventor: Ronald S. Sorokan, 8 Milford Crescent, Sherwood Park, Alberta, Canada

[21] Appl. No.: 946,642

[22] Filed: Dec. 29, 1986

Related U.S. Application Data

[63] Continuation of Ser. No. 753,358, Jul. 10, 1985, abandoned, which is a continuation of Ser. No. 697,433, Feb. 1, 1985, abandoned.

[51] Int. Cl.[4] ..... B66C 23/06

[52] U.S. Cl. ..... 52/120; 52/116; 414/917

[56] References Cited

U.S. PATENT DOCUMENTS

| | | | |
|---|---|---|---|
| 2,181,881 | 12/1939 | Ferris | 414/917 X |
| 3,228,151 | 1/1966 | Woolslayer et al. | 52/116 X |
| 3,638,375 | 2/1972 | Vasilier et al. | 52/116 |
| 3,807,109 | 4/1974 | Jenkins et al. | 52/120 |
| 3,922,825 | 12/1975 | Eddy et al. | 52/116 |
| 4,375,241 | 3/1983 | Gallon | 52/115 X |

*Primary Examiner*—Carl D. Friedman

*Attorney, Agent, or Firm*—Lalos & Keegan

[57] ABSTRACT

A drilling derrick assembly is described which provides for the elevation above ground level of the assembly's working floor which supports both the mast and the drawworks. Prior to erection, the elevatable equipment floor is carried on a supporting substructure, and a mast is pivotally connected to the elevatable floor in a reclining position. When the assembly is erected, the mast is pivotally raised and attached in place, and other rigging steps can be carried out. Through the use of an integrally mounted sling and winch assembly or, alternatively, through operation of the assembly's traveling block, the entire equipment floor is elevated to the desired level.

95 Claims, 10 Drawing Sheets

DRILLING DERRICK ASSEMBLY

This application is a continuation of prior complete application Ser. No. 753,358, filed on July 10, 1985, which is a continuation of Ser. No. 697,433, filed on Feb 1, 1985, both abandoned.

BACKGROUND OF THE INVENTION

This invention relates to drilling structures and, particularly, drilling structures wherein it is required that the working or equipment floor be elevated to a position above ground level.

For many drilling operations, such as when petroleum is to be extracted, it is necessary to drill relatively deep wells, thereby requiring longer drill strings and larger traveling blocks and hooks, all of which necessitate the use of greater mast heights. In order to accommodate the latter requirements for deep-well drilling, it is has become the custom to use an equipment floor on which are mounted drawworks and other drilling equipment which is elevated above ground level. For example, the equipment floor may need to be located as much as 25 feet or more above the ground. Such raised equipment floors are needed to provide clearance for relatively tall blow-out prevention apparatus.

In order to accommodate the need for an elevated equipment floor, numerous structures have evolved, but, in many respects, they have proven deficient. Most particularly, prior art elevated floor structures have proven to be relatively complex and time consuming to assemble at the drilling site, and, for this reason, are expensive to assemble and use. In many such prior art structures, the elevated floor and then the mast must be constructed and connected together in, essentially, a piece-by-piece operation, very often requiring the use of a crane which thereby increases the expense. Further, when such structures are finally erected, the rigging or outfitting of them must be carried out at the elevated level further requiring the use of a crane and enormously complicating the rigging process.

Examples of such prior art structures include those which have a relatively low substructure supporting a tall mast, and the elevated equipment floor is inserted in the mast at a given distance above ground level. Usually, an additional elevated support structure is provided for the drawworks. Quite clearly, in such an arrangement, the rigging operation must be carried out at an elevated level requiring the use of cranes and, prior to rigging being able to occur, it is necessary that separate raising operations be carried out for the various portions of the equipment floor. This arrangement, therefore, produces a complex arrangement for constructing the elevated floor, as well as an expesive rigging operation.

It is an object of this invention to provide a drilling structure having a mast and elevatable equipment floor which is relatively easy and inexpensive to assemble and rig.

Another object is to provide a drilling structure having an elevatable equipment floor, wherein the assembly can be fully rigged or outfitted at substantially ground level.

A further object of this invention is to provide a drilling structure having the capability of elevating the equipment floor utilizing hoist mechanisms which are a part of the drilling structure.

An additional object of this invention is to provide a drilling structure having an elevatable equipment floor on which a mast is raised and then the equipment floor, including the raised mast, is raised to the desired elevated position.

Still another object of this invention is to provide a drilling structure having a self-elevating equipment floor on which is mounted a cantilever floor-mount mast, wherein the mechanical arrangement is usable both for large and small drilling assemblies.

SUMMARY OF THE INVENTION

The foregoing and other objects are obtained in a drilling structure or drilling derrick assembly which has a substructure for support of the entire assembly and an elevatable floor assembly which, prior to erection, substantially rests on the substructure. A mast which is carried in a reclining position prior to erection is pivotally connected to the elevatable floor assembly for raising to a vertical position. An elevating mechanism is provided for raising the elevatable floor assembly which includes the mast, and can include the drawworks, to a desired elevated position above the aforementioned substructure. The elevated assembly, so raised, is then supported above the substructure and is ready for commencement of the drilling operation.

BRIEF DESCRIPTION OF THE DRAWINGS

The principles of the invention will be best understood by reference to the descriptions of alternative preferred embodiments given hereinbelow in conjunction with the drawings which are briefly described in the following.

DESCRIPTION OF THE PREFERRED EMBODIMENTS

Figure 1:
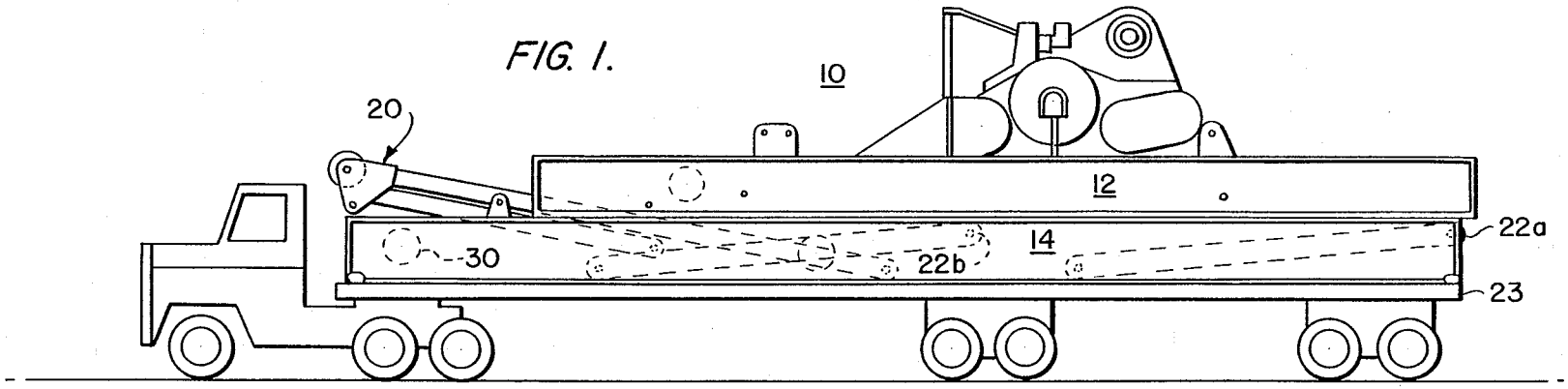
FIG. 1 is a side elevation of a first preferred embodiment of a drilling derrick assembly floor structure constructed in accordance with the invention in a collapsed or lowered form and without the mast, as arranged for transportion purposes.

In FIG. 1 is illustrated a drilling derrick elevatable floor assembly constructed according to the principles of the invention in a collapsed or lowered position for transport. The illustrated structure does not include a mast or gin pole assembly 10 for erecting the mast, and these may be transported separately.

The illustrated embodiment includes a substructure 14 having an elevatable equipment floor 12 resting thereon. Each of the substructure and elevatable floor may be constructed in a variety of ways. For example, the sides may be formed by I-beams or box girders, and these might be interconnected by spreaders or other cross-members. In any event, either of these portions of the structure may be constructed in any desired manner to achieve the desired structural integrity and provide the support required for the equipment used.

A collapsible elevating frame 20 is shown as resting on substructure 14, in and under elevatable floor 12, and forwardly thereof. Brace members 22*a* and 22*b* in their lowered positions rest within substructure 14 and under the elevatable floor 12. Although not shown, an additional pair of like brace members is provided for the other side of the elevatable floor.

The drawworks 16 for the drilling structure is assembled in this case and rests on elevatable floor 12. Additionally, a shoe 19 is provided having holes for receiving connections for the mast and, at least, a portion of gin pole assembly for raising and supporting the mast. An additional shoe 18 is provided for another connection point for the particular gin pole assembly to be described hereinbelow.

The structure described above is, in this case, supported on a trailer 23 of a tractor-trailer assembly for transport to the desired drilling location. In certain situations with smaller drilling rigs, it may be desirable to have a mast connected to the elevatable floor and transported along therewith in a reclining position. In that case, the mast might be transported in parts or slave trailers provided, as needed.

Figure 2:
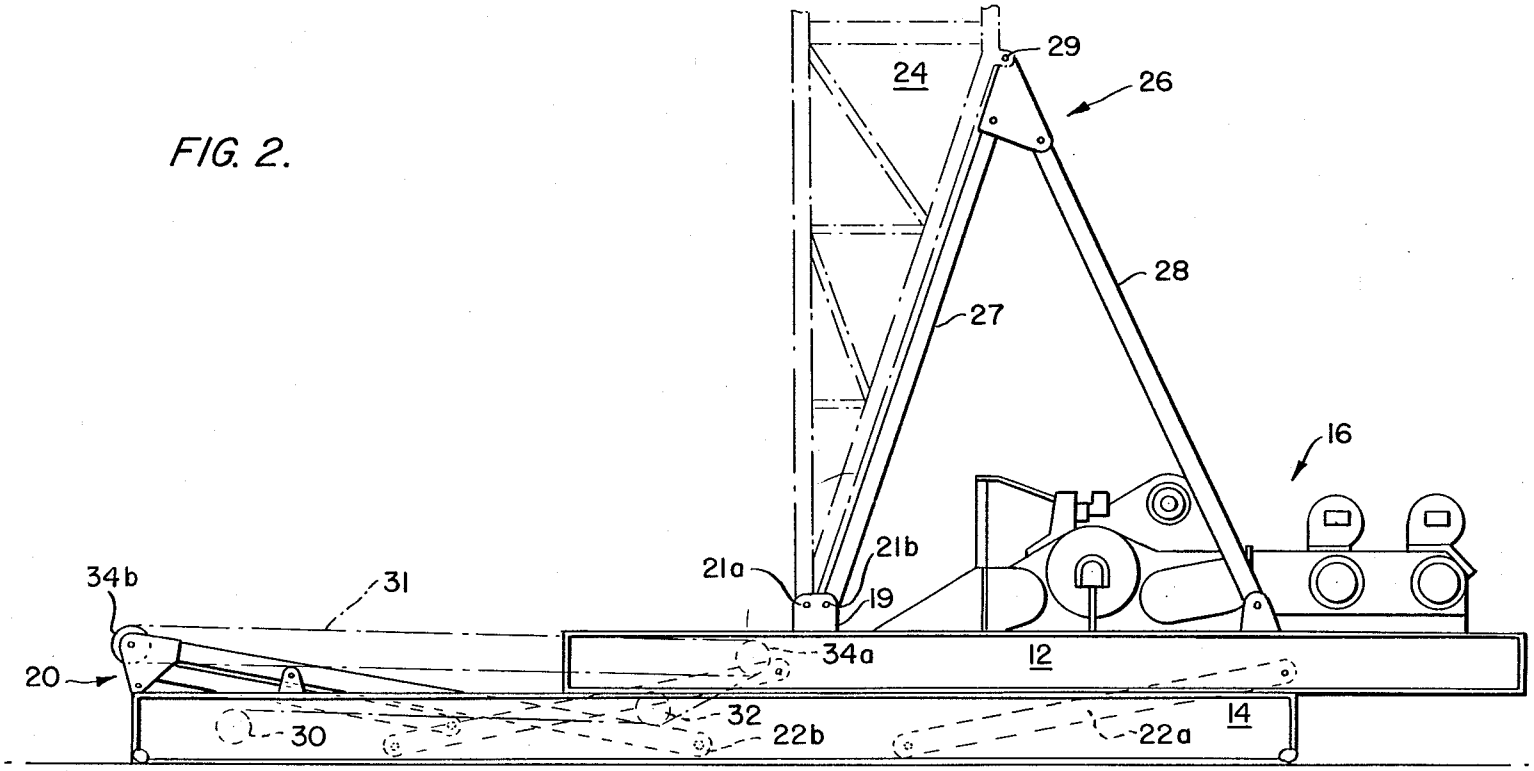
FIG. 2 is a side elevation of the FIG. 1 embodiment placed on the surface to be drilled and illustrating the mast in connected and raised form.

The drilling structure of FIG. 1 is similarly illustrated in FIG. 2, but removed from the tractor-trailer and placed at the location where drilling is to occur. Additionally, a mast 24 is shown as being fully erected on elevatable floor 12 and attached to a gin pole assembly 26. Mast 24 is a conventional angle leg, floor mount cantilever mast which may be of any desired height. This particular type of mast is especially designed to be portable and includes the usual equipment, such as a crown block at the top. In the side elevation shown, the longer beam 25 of mast 24 is pivotally connected to shoe 19 at 21*a*. A shoe similar to 19 is provided on the other side of elevatable floor 12 and a similar connection is made to the corresponding mast beam on that side. It is to be noted that similar connecting shoes are provided on the other side of structures. Gin pole assembly 26 is a generally A-shaped structure having forward leg 27 and a rearward leg 28 which are connected at 29 and, at the same point, the mast is pin connected to the gin pole assembly. The lower portion of leg 27 is pin connected to shoe 19 at 21*b*, and the lower portion of leg 28 is pin connected to shoe 18 at 21*c*.

The equipment required for and the technique of raising a mast of the particular type described herein from a reclining position to the vertical position using gin pole assembly 26 is not fully illustrated herein in order to not obscure the description of the invention with unneeded detail. However, this is a well-known technique as exemplified by the description given in U.S. Pat. No. 3,141,653. As therein pointed out, it is common practice to erect a drilling mast of the type here in question by first assembling it in a reclining position and pivotally mounting it to a base, such as elevatable floor 12. A gin pole is then erected on the base behind the reclining mast. A fast line extends from the drawworks also mounted on elevatable floor 12 up over the top of a removable sheave placed at point 29 on gin pole assembly 26 and forward to the crown block which is now at the front end of the reclining mast. From there, the fast line extends back into the mast to a traveling block of the conventional type. A cable sling is looped over the hook of the traveling block at substantially the central part of the sling, and the two ends of the sling extend back beneath sheaves journaled in the mast, and then up to the top of the gin pole assembly. The sling line is extended around sheaves supported by the top of the gin pole and then forward to the top of the reclining mast where the ends of the sling line are anchored. Thus, when the drawworks is operated to pull the traveling block toward the crown block of the mast, the sling is pulled farther into the mast with the result that the mast is swung to an upright position against gin pole assembly 26 where it can be securely pinned as shown at 29.

This figure additionally illustrates the equipment and rigging required for raising elevatable floor 12 after mast 24 reaches its upright position. As previously stated, collapsible elevating frame 20 which will assume a generally triangular shape, when raised, plays a substantial role in both raising and supporting the elevatable floor. While, in the side elevation, only one such collapsible elevating frame 20 is shown, it will be appreciated that in the preferred embodiment, such elevating frames are provided on either side of substructure 14 and, in fact, a second set of equipment and rigging is provided in conjunction with the latter elevating frame structure. For purposes of clarity, the equipment appearing on the shown side only is described. In order to effect the raising of elevatable floor 12 in a manner to be more fully described below, winch 30 is rotatably mounted in substructure 14 in any desired manner. Similarly, an idler sheave 32 is carried in substructure 14 rearwardly of winch 30. An elevating block 34a is rotatably mounted in elevatable floor 12, and elevating block 34*b* is rotatably mounted at the apex of elevating frame 20. An elevating line 31 extends from winch 30 around sheave 32 and makes a plurality of runs between blocks 34*a* and 34*b*. Thus, in the arrangement as shown, counterclockwise rotation of winch 30 will reel in line 31 causing the blocks 34*a* and 34*b* to operate in the usual manner to, in this case, pull block 34*a* toward block 34*b*.

Figure 3:
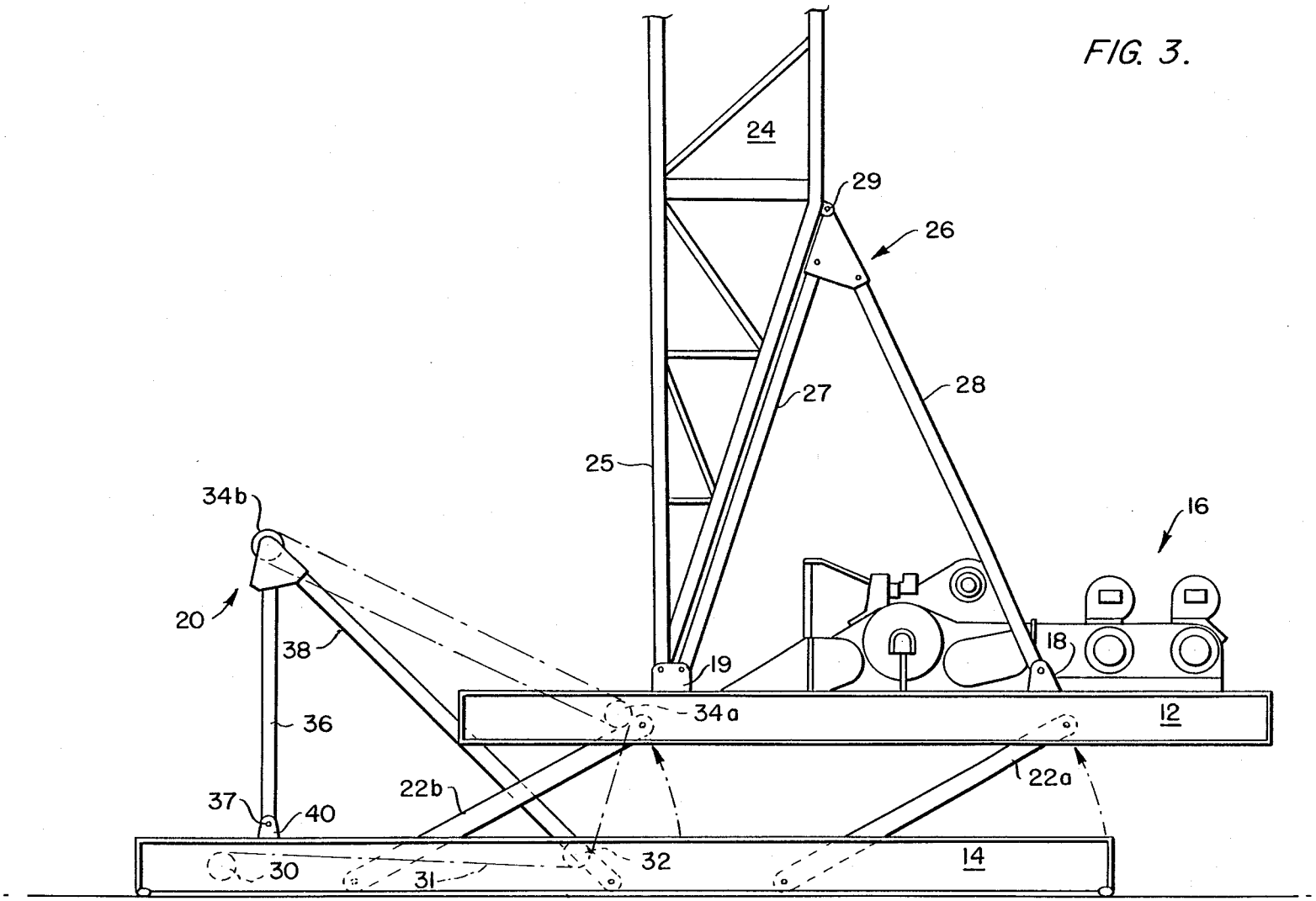
FIG. 3 is a side elevation of the FIG. 2 embodiment illustrating the rigging for the elevatable mast floor at a point in the assembly where elevation of the floor has commenced.

FIG. 3 provides a further illustration of the structure illustrated in FIG. 2 wherein the elevating frames 20 have been fully erected, and the raising operation of elevatable floor 12 has commenced.

Elevating frame 20 is constituted by a forward leg 36 and a rearwardly extending brace member 38. Leg member 36 is pin connected at 37 to a shoe 40 on the forward portion of substructure 14. The lower portion of rearwardly extending brace member 38 is similarly pin connected at 41 to the substructure 14. The latter two members are connected to form an apex about which elevating block 34*b* is rotatably mounted. This elevating frame fixedly supports the latter elevating block and provides structural support to elevatable floor 12 when it is fully raised. Although not shown in this illustration, for example, leg member 36 may, in fact, be constructed from parallel vertical beams interconnected by lacing members to provide needed structural integrity.

Supporting brace members 22*a* and 22*b* are pivotally connected to the sides of elevatable floor 12 and substructure 14 as shown at 42*a–d*. Similar supporting brace members are provided on the other side of the structure, and they are connected in the same manner. The supporting brace members form with the corresponding sides of elevatable floor 12 and substructure 14 a parallel linkage. Thus, as n elevating block 34*a* is pulled toward block 34*b* by operation of winch 30, the aforementioned parallel linkage causes elevatable floor 12 to proceed upwardly and forwardly in substantially an arc-like motion.

Figure 4:
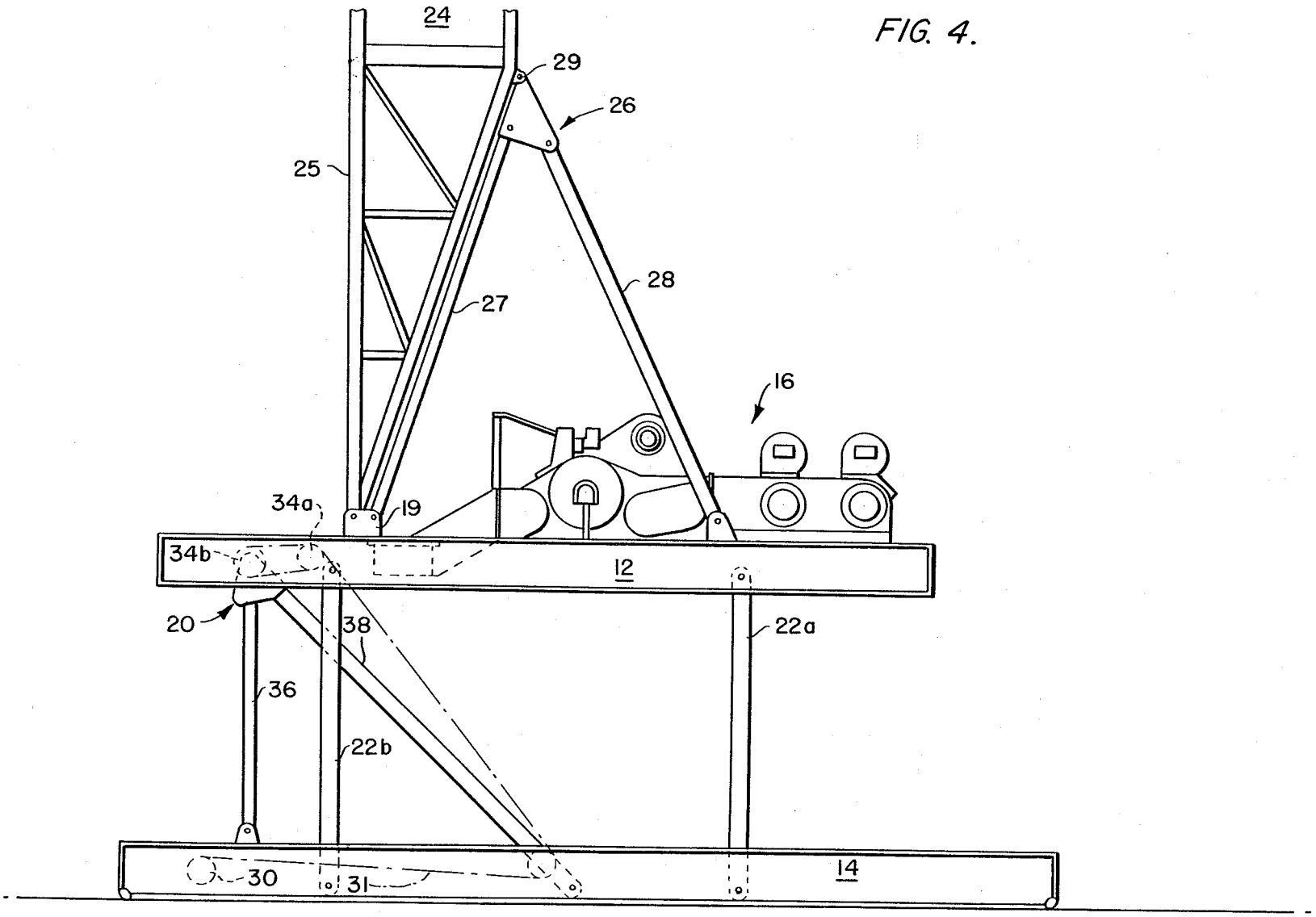
FIG. 4 is a side elevation of the FIG. 2 embodiment wherein the drilling structure is fully assembled and the elevatable mast floor is in its fully elevated position.

Referring to FIG. 4, it will be seen that this arc-like motion continues until the supporting brace members 22*a* and 22*b* are in this example vertical where elevatable floor 12 extends over elevating frame 20. Other forms of bracing structures not involving vertical brace members can, as well, be used. At this point, in any desired manner, the elevatable floor structure may be pinned or otherwise connected to the pair of elevating frames 20 to hold it in position. When the drilling operation is complete, the assembly steps discussed hereinabove can essentially be reversed to permit the drilling structure to be readily transported to another location as needed. Furthermore, from the foregoing description, it will be remembered that, prior to raising of elevatable floor 12, mast 24, drawworks 16 and all of the associated rigging can be in place. Therefore, as soon as the floor raising operation is complete, the assembly is ready for drilling operations to begin. It is demonstrable that this produces a substantial time saving over other known forms of drilling structures having elevated mast floors.

Figure 5:
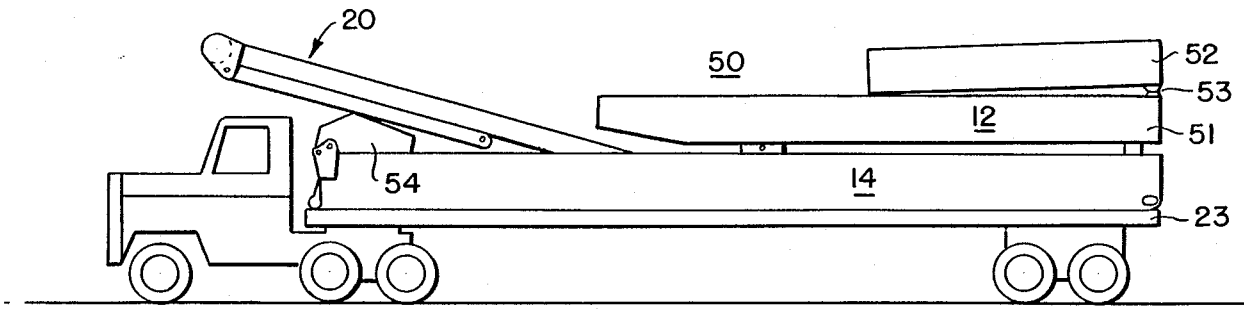
FIG. 5 is a side elevation of a second preferred form of a drilling structure constructed in accordance with the principles of the invention shown in a lowered or collapsed form and arranged for transportion.

In FIG. 5, and in succeeding figures, is illustrated a second or alternative preferred embodiment constructed according to the invention. In describing these figures, like elements, as found in FIGS. 1 through 4, will be referred to using like reference numerals.

FIG. 5, similarly to FIG. 1, illustrates a portion of a drilling structure 50 in collapsed or lowered form and mounted for transportation. Drilling structure 50 differs from that illustrated in FIG. 1 in that elevatable floor 12 is formed of two sections 51 and 52 which are pivotally connected at 53.

Figure 6:
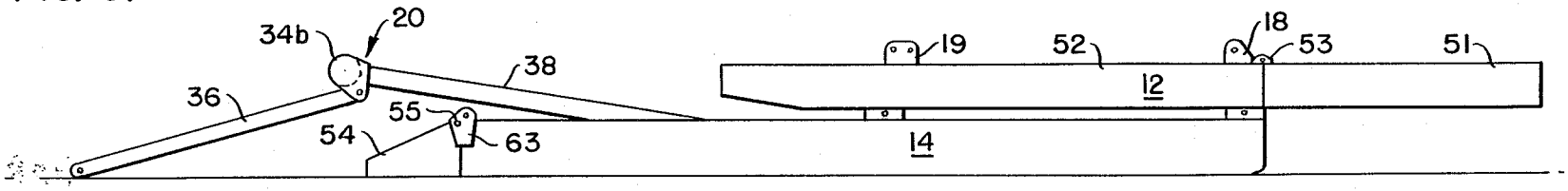
FIG. 6 is a side elevation of the FIG. 5 embodiment placed on the surface to be drilled.

Referring to FIG. 6 where drilling structure 50 is shown as being removed from trailer 23 and placed at the point where drilling operations are to occur, section 52 of elevatable floor 12 is pivoted to form a rearward extension of section 51. Further, as erection of the entire assembly commences, elevating frame 20 is raised to an extent necessary to extend leg member 36 as shown. Skid members, such as 54, are provided for the substructure 14, and these are pivotally connected as at 55 to permit them to be lowered in the manner shown. Elevatable floor 12 is equipped with a shoe 18 to receive a portion of a gin pole assembly as described hereinabove, and a shoe 19 forwardly of shoe 18 is provided for receiving the front portion of the gin pole assembly and the lower end of a mast.

Figure 7:
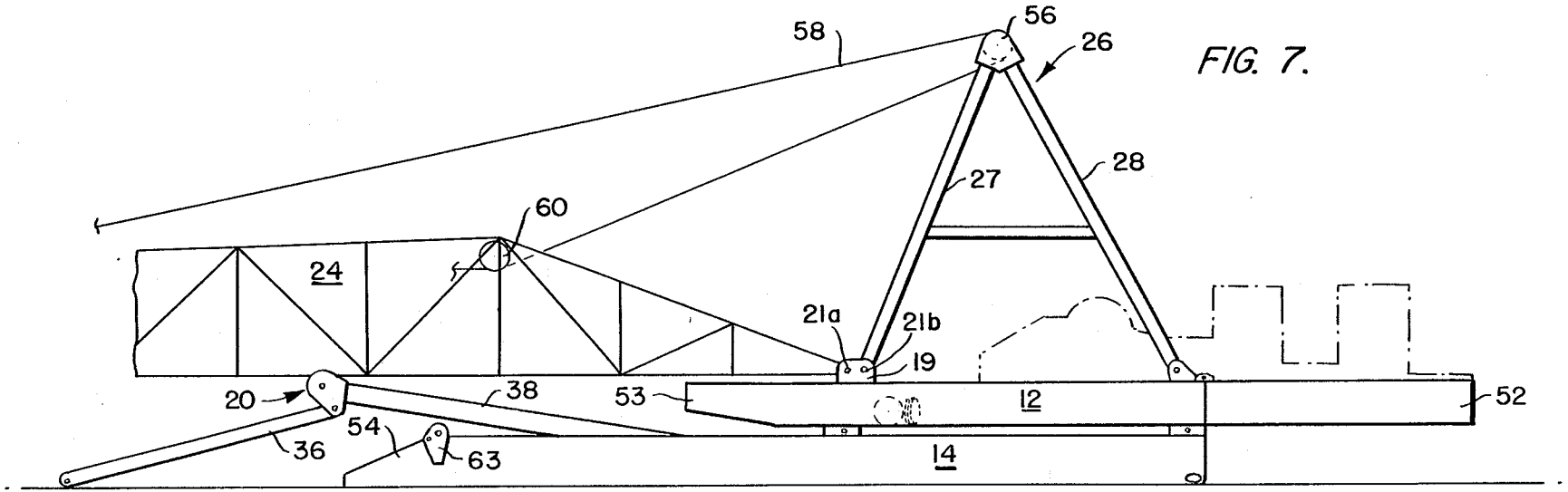
FIG. 7 is a side elevation of the FIG. 6 embodiment wherein the mast is connected along with a gin pole assembly for raising the mast prior to elevation of the equipment floor.

In FIG. 7, the assembly is shown as having the gin pole assembly 26 erected and connected at 21*b* and 21*c* to, respectively, shoes 19 and 18. Mast 24, of the same type as described hereinabove, is connected at its lower apex at 21*a* to shoe 19 as well. A partial showing is given of the rigging necessary for raising the mast in the manner described hereinabove. In particular, a sheave 56 is provided at the apex of the A-shaped gin pole assembly. As described hereinabove, a sling line 58 is reeved about sheave 56 at the gin pole assembly and about a sheave 60 to a traveling block (not shown). The other end of the sling line 58 extends to a deadend at a not-shown upper portion of the mast. As described hereinabove, another line, referred to as a fast line, although not shown herein, simply extends from the drawworks about sheave 56, about a crown block at the upper end of mast 24 and then to the aforementioned traveling block. The drawworks then operates to move the traveling block upwardly thereby pulling mast 24 upwardly by means of sling line 58.

Figure 8:
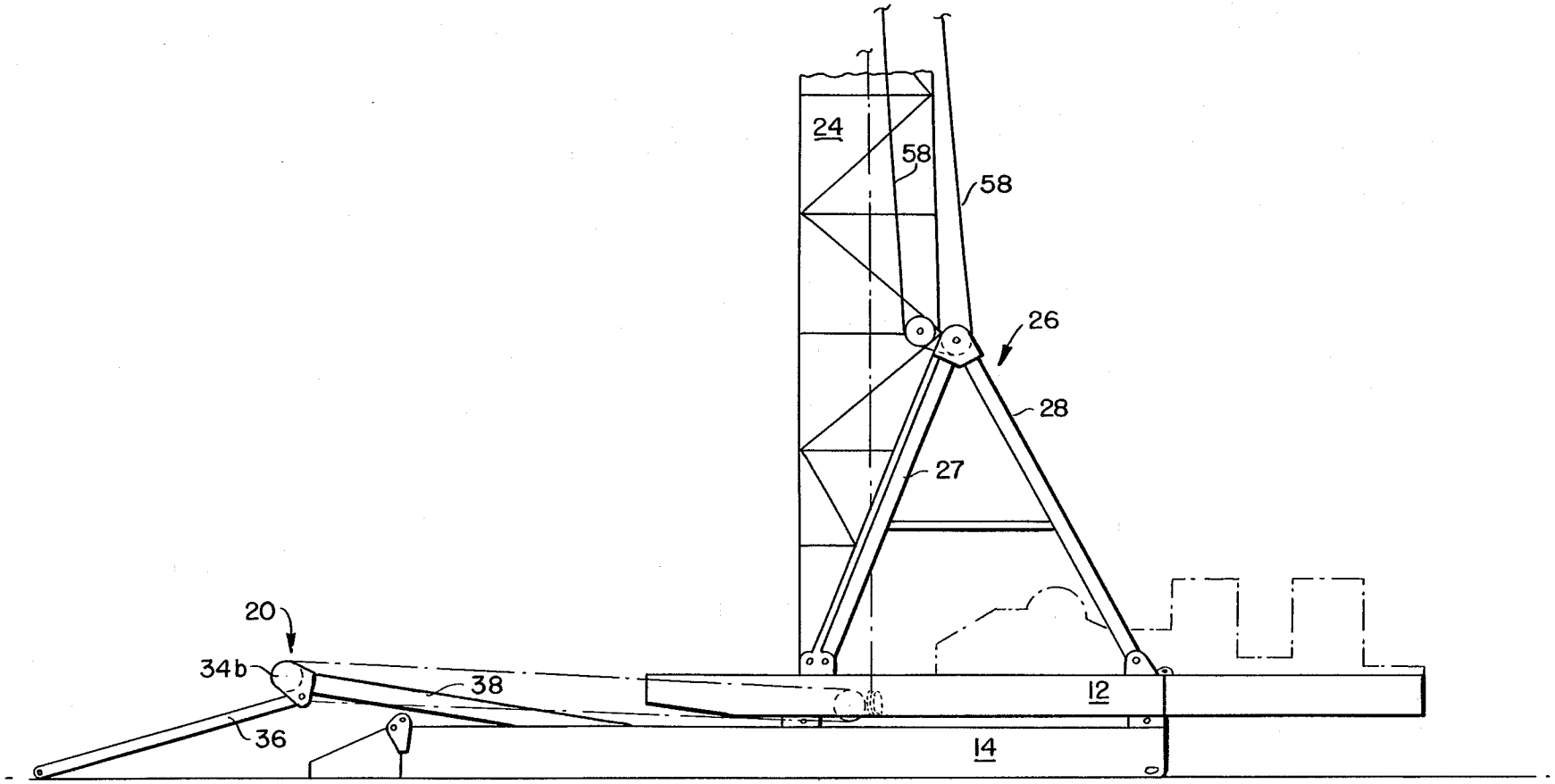
FIG. 8 is a side elevation of the FIG. 7 embodiment wherein the mast is in a fully raised position.

In FIG. 8, mast 24 is shown raised to its erected position, which operation is completed as described above.

Figure 9:
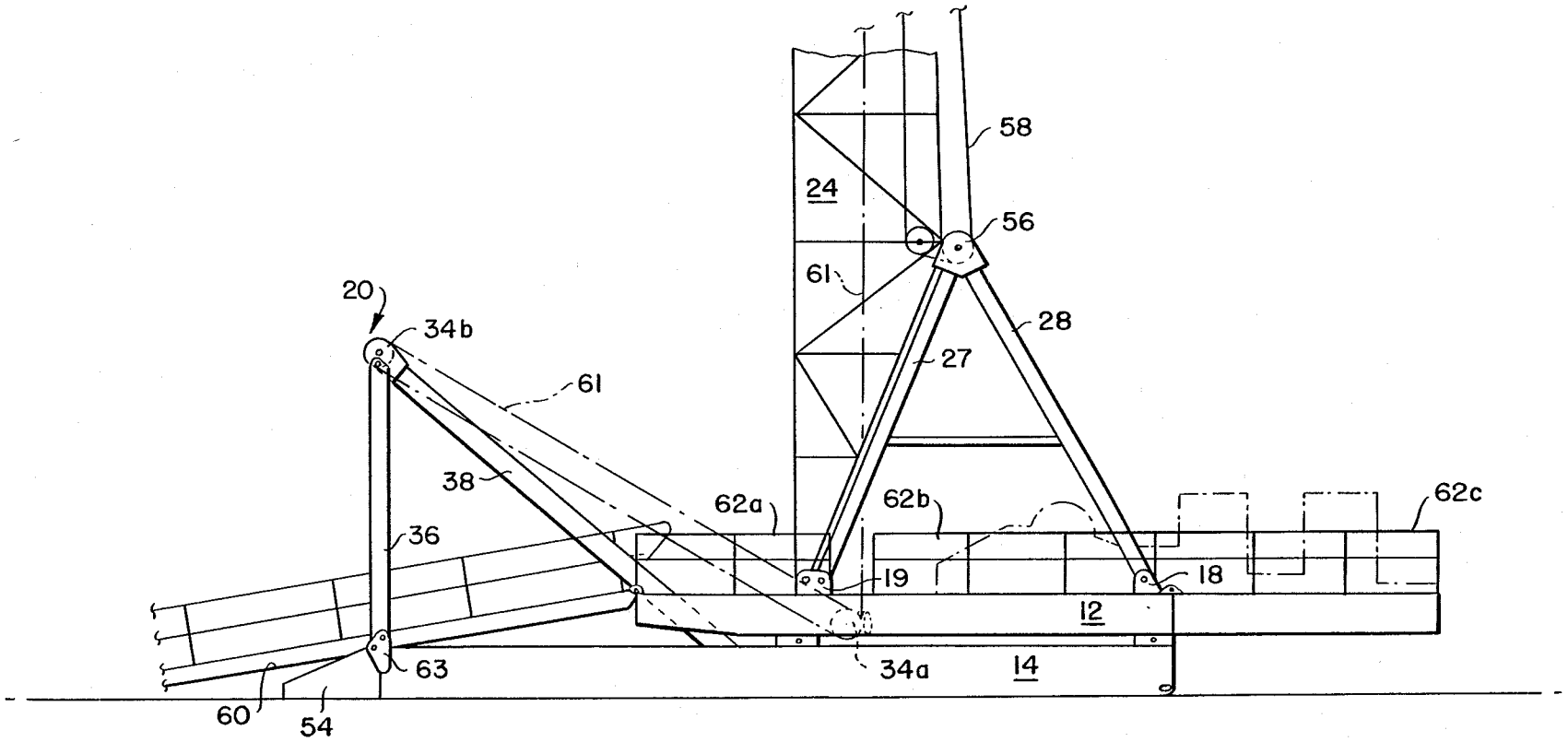
FIG. 9 is a side elevation of the FIG. 8 embodiment illustrating the completion of rigging and outfitting prior to raising of the equipment floor, as well as illustrating the rigging arrangement for elevating the equipment floor.

FIG. 9 illustrates further steps in the assembly procedure in that elevating frame 20 is raised as described hereinabove. This elevating frame is constructed as in the first embodiment described above. It is to be remembered that in this embodiment, as well, a pair of elevating frames 20 is provided with a frame substantially arranged on each side of the substructure 14. The lower end of leg member 36 of elevating frame 20 is pinned as shown in bracket 63 which also carries the pivotal connection for skid member 54. The raising of the elevating frame can occur, as described hereinabove, through the use of elevating blocks 34*a* and 34*b*. However, as will be described more fully hereinbelow, the source of motive power for operation of these blocks is obtained through a traveling block within the mast and, ultimately, from drawworks 16.

This figure provides a brief illustration of the reeving for elevating blocks 34*a* and 34*b* in that an elevating line 61 extends downwardly from a traveling block (not shown) about direction-changing sheaves, not clearly shown in this figure, (see below) and then to the elevating blocks. Thus, as stated, operation of the drawworks to move the traveling block in this arrangement produces operation of the elevating blocks 34*a* and 34*b*.

As illustrated, at this point in the erection procedure, a ramp 160 is pivotally attached to shoe 163 at a forward end of elevatable floor 12. Rail members 62*a–c* are attached at the edges of the upper elevatable floor 12. It is to be pointed out that such rail and ramp components might well be used with the FIG. 1 embodiment.

Figure 10:
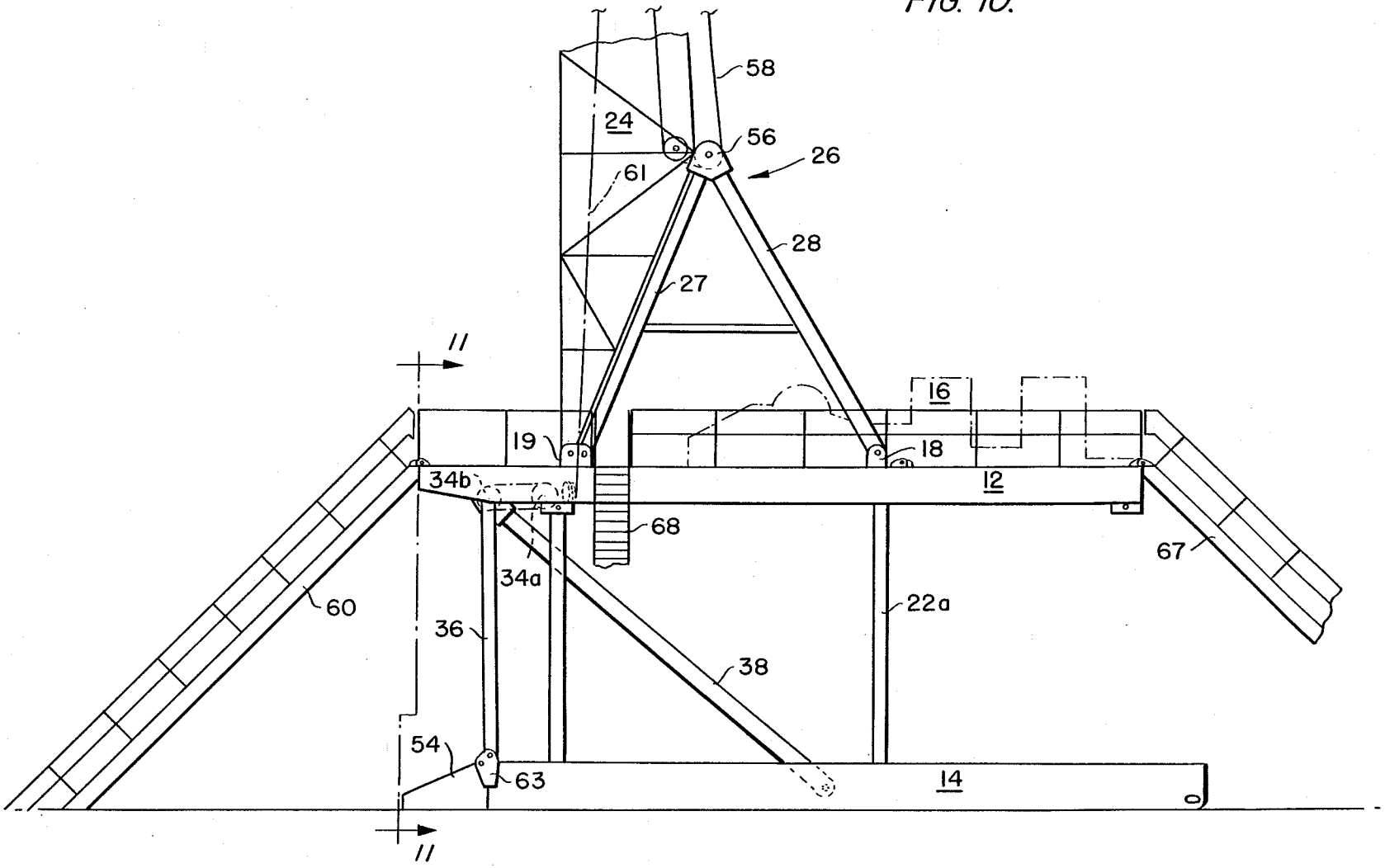
FIG. 10 is a side elevation of the FIG. 9 embodiment wherein the elevatable mast floor is in its fully raised position.

FIG. 10 is a side elevation illustrating the entire drilling structure after erection is complete. The elevatable mast floor 12 is raised to its full vertical position so that supporting brace members 22*a* and 22*b* and similar members on the other side of the structure are, as well, fully vertical. Elevatable floor 12, at this point, is pin connected to appropriate means provided therefor on elevating frame 12, as will be described below. In this fully raised position, an additional ramp 67 is provided and attached as shown, and a stairway 68 is attached between railings 62*a* and 62*b*.

Figure 11:
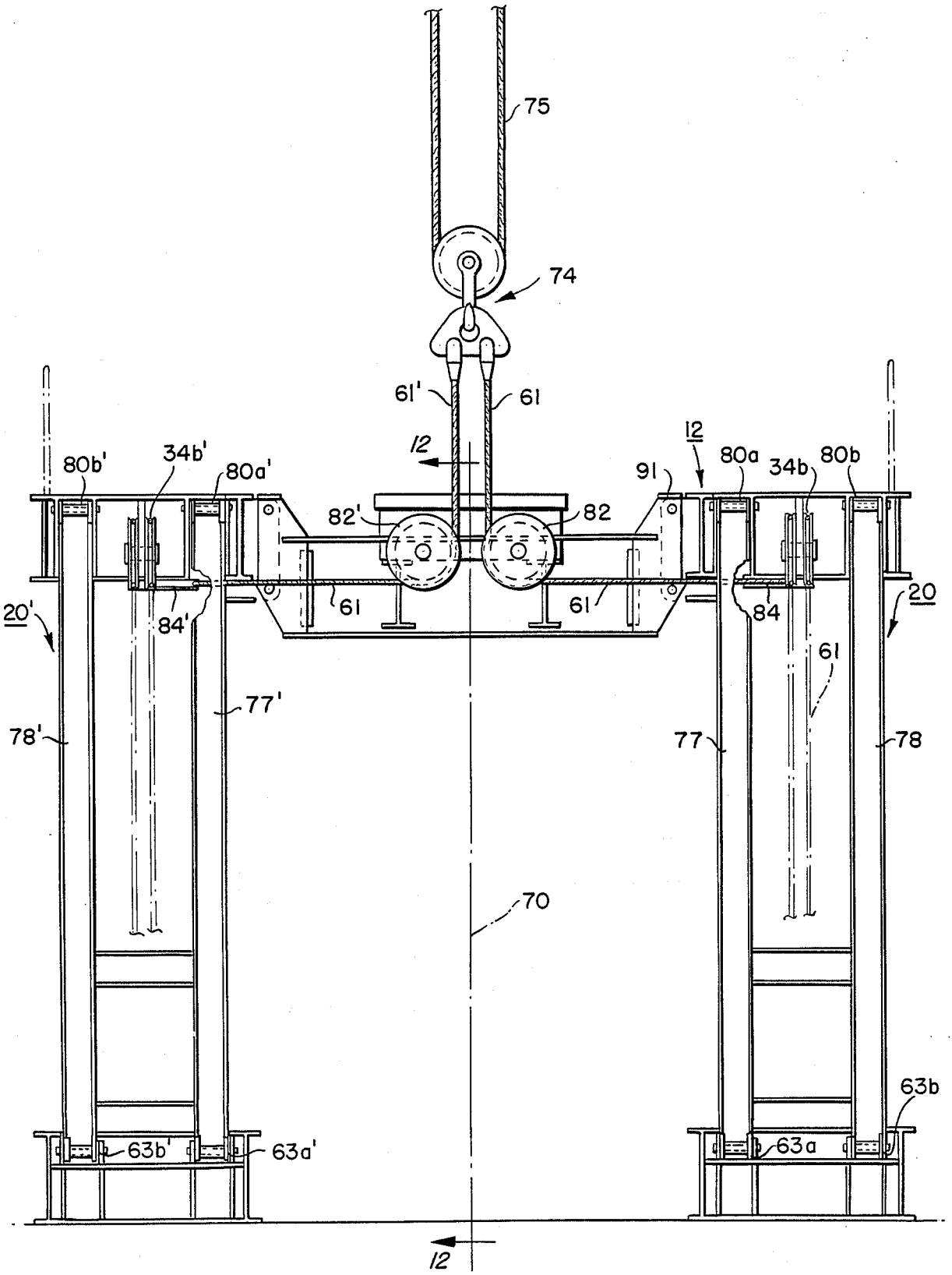
FIG. 11 is a side elevation as viewed from the line 11—11 in FIG. 10.
Figure 12:
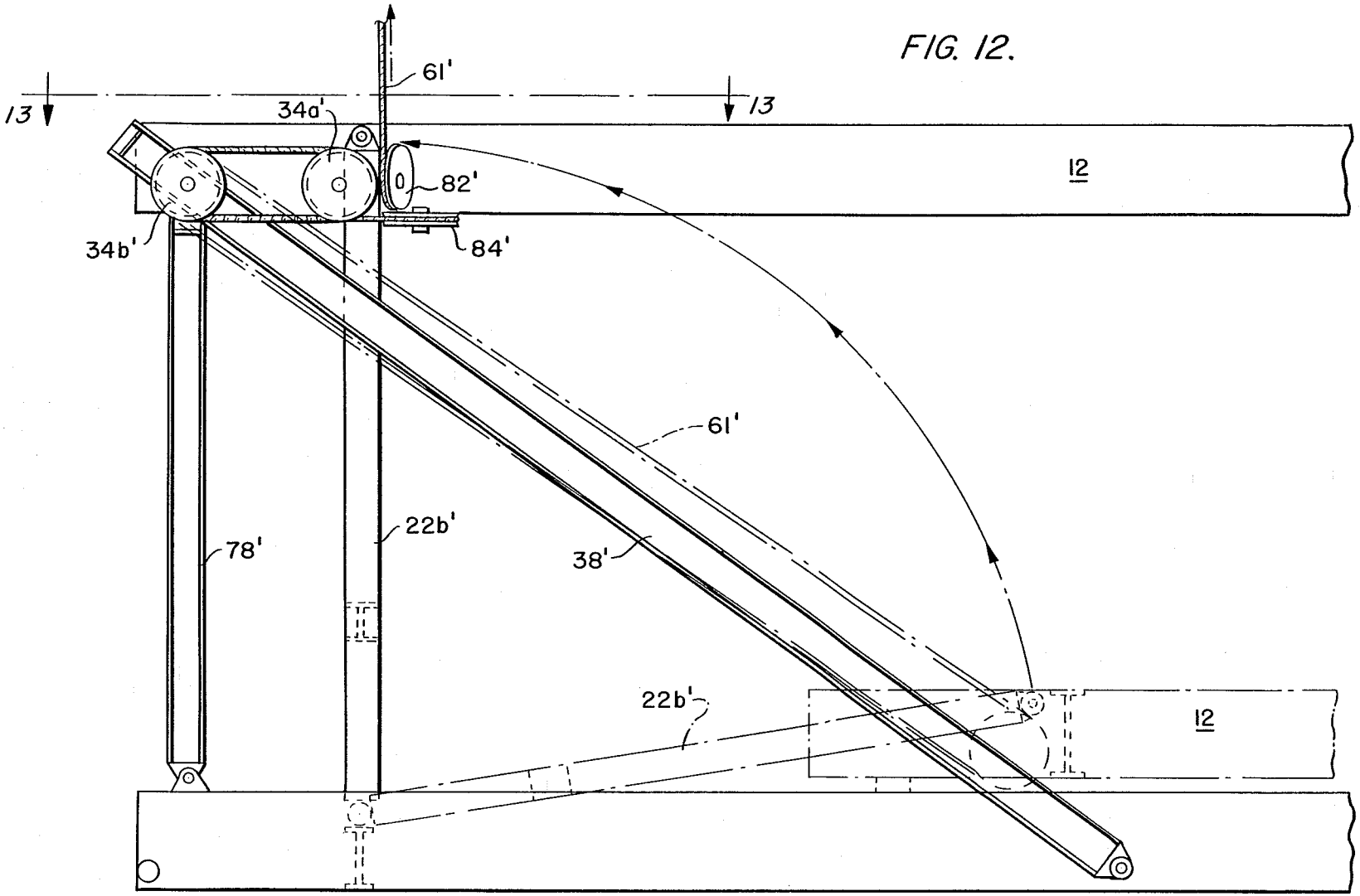
FIG. 12 is a partial cross-sectional view taken along the line 12—12 in FIG. 11.
Figure 13:
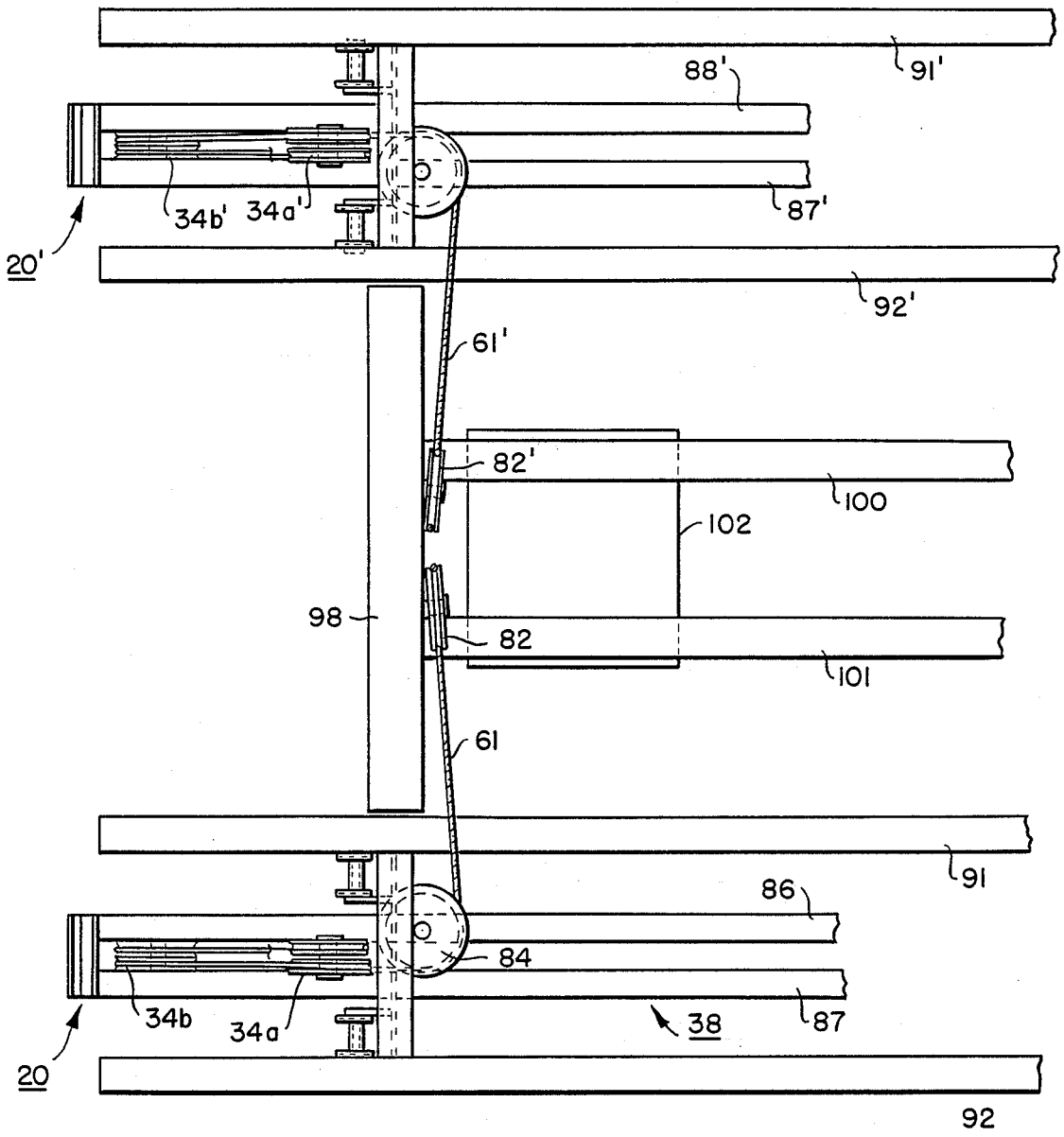
FIG. 13 is a top elevation as viewed from the line 13—13 in FIG. 12.

FIGS. 11 through 13 provide additional details regarding the reeving for the mode of raising elevatable floor 12 in this alternative preferred embodiment, as well as providing additional structural details regarding the construction of elevatable frames 20, the substructure and elevatable floor.

FIG. 11 is a partial side elevation taken along the line 11—11 in FIG. 10. Those components shown to the right of center line 70, in this figure, are those which were illustrated and described hereinabove. Those same components are duplicated to the left of center line 70 and in order to simplify description, since duplicates are involved, like components to the left of center line 70 will be indicated with primed reference numerals.

As is apparent, substructure 14 is made up of a pair of parallel supporting beam structures 76 and 76'. Substructure beam 76 supports elevating frame 20, the forward leg portion 36 of which is constituted by a pair of leg beam members 77 and 78. These leg beam members, at their lower ends are pinned in brackets 63*a* and 63*b* which are formed integrally with the substructure members 76. This may be a pivotal connection in view of the fact that the elevating frame assembly may desirably be lowered as necessary to meet roadway clearances, or the like, during transportation.

The leg beam members 77 and 78 at their upper ends are terminated in brackets 80*a* and 80*b* which correspond with like brackets formed in elevating floor 12. Thus, the elevatable floor structure can be pinned, as shown, when it reaches its full vertical height. The elevating block 34*b*, discussed hereinabove, is rotatably mounted between the leg beam members 77 and 78 at the upper ends thereof.

As described hereinabove, elevating line 61 extends from a traveling block 74 which, in turn, is connected to the crown block via line 75. The crown block is operated by the drawworks in the conventional manner. Line 61 extends downwardly from traveling block 74, where its travel is changed from the vertical to the horizontal by idler pulley 82. Elevating line 61 then proceeds to a horizontally positioned idler pulley 84 from where it is fed to the elevating block 34*b*. The elevating line is connected in the series of runs in the usual manner to elevating block 34*a*. Thus, when the drawworks is operated to move traveling block 74 upwardly, elevating block 34*a* will be drawn toward elevating block 34*b* via elevating line 61, and the net mechanical result will be the raising of elevatable floor 12.

FIG. 12 is a partial cross-sectional view taken along the line 12—12 in FIG. 11.

This figure provides a good illustration of the reeving arrangement and operation to effect raising of elevatable floor 12. It will be remembered that this figure provides an illustration of components on a side opposite the side illustrated in the previous figures, but the illustrated components on both sides of the structure are identical. As indicated in this figure, elevating line 61' extends downwardly from the traveling block 74, proceeds about idler pulley 82' to horizontal idler pulley 84' from where it extends to and about in a plurality of runs elevating blocks 34*a*' and 34*b*'.

In the lowered position of elevatable floor 12, as shown in dashed line in the figure, elevating block 34*a*' is at its greatest distance from elevating block 34*b*'. As the traveling block is moved upwardly, elevating block 34*a*' is pulled toward elevating block 34*b*' until it assumes the position shown in the upper part of FIG. 12. At this point, the elevatable floor will be at its greatest vertical height and will be fully raised. This figure also shows the operation of a brace member 22*b*' which pivots about connecting point 32' so that its outer end moves in an arc-like motion. As indicated hereinabove, the overall structure functions as a parallel linkage to raise the elevatable floor vertically.

FIG. 13 is a top elevation taken along the line 13—13 in FIG. 12. This figure illustrates partially the beam construction of elevatable floor 12 and the relationship between the reeving members in the elevating frames and the elevatable floor.

Elevatable floor 12 includes parallel support members 90 and 90' which are primarily formed of parallel beams 91 and 92 and 91' and 92'. Referring specifically to member 90, it may include a number of spreader members between the beams 91 and 92, only one of which, 93, is illustrated in this figure. Shoes 95 and 96 are provided on beams 91 and 92 for receiving in a pivotal pin connection from the supporting brace member, such as brace member 22 in this case.

The rearwardly sloping leg 38 of elevating frame 20 is made up of parallel braces 86 and 87. Elevating block 34*b* is rotatably mounted between braces 86 and 87.

The center portion of elevatable floor 12 includes a series of cross members, one of which is shown at 98. Member 98 supports idler pulleys 82 and 82'. The elevatable floor, at it center portion, includes longitudinal beam members 100 and 101 which also may be interconnected by spreaders or cross-beam members, as necessary. In order to understand the proper positioning of the elevatable floor with respect to the mast and the reeving equipment, the rotary table area is shown diagrammatically at 102.

The foregoing detailed descriptions described alternative embodiments of a drilling derrick structure having an elevatable equipment or mast floor wherein the structure is constructed and arranged to permit rigging or outfitting of the structure prior to drilling, and then elevation of the mast floor including the mast and all necessary equipment, including drawworks to the desired level. Rigging of the structure can be accomplished in a minimum amount of time relative to other forms of elevated mast floor structures because the rigging can be carried out at ground level. When the structure is erected and rigged, it can be raised to the desired level in a minimum amount of time with little or no complexity so that the overall time for erection, rigging and elevation is so reduced that great economic savings are realized in beginning drilling operations.

It should be noted that the detailed description given hereinabove is intended only to be exemplary of the principles of the invention. It is contemplated that the described embodiments can be modified or changed in a variety of ways known to those skilled in the art without departing from the spirit or scope of the invention, as defined in the appended claims.

I claim:

1. A drilling structure comprising:

a substructure for supporting the drilling structure on the surface through which drilling is to occur, an elevatable floor assembly which rests on said substructure in its lowered position, a reclining mast pivotally connected to said elevatable floor, a gin pole assembly mounted on said elevatable floor assembly rearwardly of the point at which said mast is pivotally connected to said elevatable floor and arranged to receive line for raising said mast, whereby said mast is raised prior to raising said elevatable floor assembly, a collapsible vertically standing elevating frame assembly mounted on said substructure and forwardly of said mast, when raised, and the forwardmost end of said elevatable floor assembly, winch means rotatably mounted in and arranged adjacent the forwardmost end of said substructure, a first elevating block means mounted in said elevatable floor and rearwardly of said elevating frame assembly, a second elevating block mounted on said elevating frame assembly at a vertical point corresponding with the level to which said elevatable floor is to be raised, an elevating line extending from said winch means and reeved about said elevating block so that motion of said winch means in one direction causes said second elevating block to move toward said first elevating block raising said elevatable floor vertically and forwardly, motion of said winch means in another direction lowering said elevatable floor vertically and rearwardly, and a brace member on each side of the drilling structure, each brace member being pivotally connected at its ends, respectively, to said substructure and said elevatable floor, said brace members being arranged in pairs forming parallel linkages thereby causing said elevatable floor assembly to be raised in an arc-like motion.

2. The drilling structure defined in claim 1 further comprising an idler sheave mounted in said substructure rearwardly of said winch means, said elevating line extending from said winch means, around said idler sheave and then to said elevating blocks.

3. The drilling structure defined in claim 1 further comprising drawworks mounted on said elevatable floor assembly prior to the latter being raised.

4. The drilling structure defined in claim 1 further comprising means for pinning said elevatable floor assembly in its raised position to said elevating frame assembly.

5. The drilling structure defined in claim 1 wherein said winch means is driven from an external source of motive power.

6. A drilling structure comprising:

a substructure for supporting the drilling structure on the surface through which drilling is to occur, an elevatable floor assembly which rests on said substructure in its lowered position, a reclining mast pivotally connected to said elevatable floor assembly to be raised thereon, a gin pole assembly mounted on said elevatable floor assembly rearwardly of the point at which said mast is connected to said elevatable floor assembly and arranged to receive lines for raising said mast, whereby said mast is raised prior to raising said elevatable floor assembly, a traveling block carried in said mast, a crown block rotatably mounted adjacent the upper portion of said mast, a fast line for connecting said traveling block via said crown block to a source of motive power for raising and lowering said traveling block, a vertically standing elevating frame assembly mounted on said substructure forwardly of said mast, a first elevating block mounted in said elevatable floor assembly and rearwardly of said elevating frame assembly, a second elevating block mounted in said elevating frame assembly at a vertical point corresponding with the level to which said elevatable floor assembly is to be raised, an elevating line extending from said traveling block and reeved about said elevating block so that motion of said traveling block in one direction causes said second elevating block to move toward said first elevating block raising said elevatable floor assembly vertically and forwardly, motion of said traveling block in another direction lowering said elevatable floor assembly vertically and rearwardly, and a pair of brace members on each side of the drilling structure, each brace member being pivotally connected at its ends, respectively, to said substructure and said elevatable floor forming a parallel linkage thereby causing said elevatable floor assembly to be raised in an arc-like motion.

7. The drilling structure defined in claim 6 further comprising an idler pulley mounted in said elevating floor assembly for changing the direction of said elevating line as it proceeds from said traveling block from vertical to substantially horizontal to be received in said elevating blocks.

8. The drilling structure defined in claim 6 further comprising drawworks mounted on said elevatable floor assembly prior to the latter being raised.

9. The drilling structure defined in claim 6 further comprising means for pinning said elevatable floor assembly in its raised position to said elevating frame assembly.

10. A drilling structure support assembly comprising:

a substructure for supporting the drilling structure on the surface through which drilling is to occur, an elevatable floor assembly which rests on said substructure in its lowered position, means on said elevatable floor assembly for receiving a mast, a collapsible vertically standing elevating frame assembly mounted on said substructure, winch means rotatably mounted in said substructure, at least a pair of cooperating elevating blocks, one of which is rotatably mounted in said elevating frame assembly and the other of which is rotatably mounted in said elevatable floor assembly and an elevating line extending from said winch means and reeved about said elevating blocks so that motion of said winch means in one direction causes relative motion of said elevating blocks in a direction causing raising of said elevatable floor assembly and so that motion of said winch means in another direction causes opposite relative motion of said elevating blocks lowering said elevatable floor assembly.

11. The drilling structure support assembly defined in claim 10 further comprising an idler sheave mounted in said substructure, said elevating line extending from said winch means around said idler sheave and then to said elevating blocks.

12. The drilling structure floor assembly defined in claim 10 further comprising means for pinning said elevatable floor assembly in its raised position to said elevating frame assembly.

13. A drilling derrick assembly comprising:

a supporting substructure, a horizontally extending elevatable floor assembly substantially resting on said substructure, a mast, cantilever mounted on and pivotally connect to said elevatable floor assembly, said mast being elevatable from a substantially horizontal position to an upright position, elevating means for raising said elevatable floor assembly, while maintaining its horizontal attitude, to a position above said substructure, said elevating means comprising elevating frame means mounted on said substructure, at least a pair of cooperating elevating blocks one of which is rotatably mounted in said elevating frame means at substantially the vertical level to which said elevatable floor is to be raised and the other of which is carried in said elevatable floor, said blocks being arranged so that movement of said other block towards said one block causes said elevatable floor assembly to be raised vertically, winch means and line means extending from said winch means and reeved about said blocks so that operation of said winch causes motion of said other block for raising and lowering said elevatable floor assembly, said elevating means being arranged exteriorly of said mast and operable independently of said mast to exercise a substantially lateral force on said elevatable floor assembly to hoist it vertically in a generally arcuate path to said position above said substructure and supporting means for supporting said elevatable floor assembly and said mast vertically above said substructure.

14. A drilling derrick assembly comprising:

a supporting substructure, an elevatable floor assembly substantially resting on said substructure, a mast, cantilever mounted on and pivotally connected to said elevatable floor assembly, said mast being elevatable from a substantially horizontal position to an upright position, elevating frame means mounted on said substructure, at least a pair of cooperating elevating blocks, one of which is rotatably mounted in said elevating frame means at substantially the vertical level to which said elevatable floor is to be raised and the other of which if rotatably mounted in said elevatable floor, said blocks being arranged so that movement of said other block toward said one block causes said elevatable floor to be raised vertically, a traveling block arranged in said mast, a crown block arranged adjacent the upper portion of said mast, a fast line connecting said traveling block via said crown block to a source of motive power for raising and lowering said traveling block, an elevating line reeved from said traveling block and about said elevating blocks so that upward movement of said traveling block causes movement of said other elevating block thereby raising said elevatable floor assembly and supporting means for supporting said elevatable floor assembly and said mast vertically above said substructure.

15. The drilling derrick assembly defined in claim 14 further comprising drawworks mounted on said elevatable floor assembly and which forms said source of motive power for said traveling block.

16. The drilling derrick assembly defined in claim 14 wherein said supporting means comprises a pair of brace members on each side of the derrick assembly, each brace member having its ends, respectively, pivotally connected to said substructure and to said elevatable floor assembly thereby forming a parallel linkage therewith.

17. The drilling derrick assembly defined in claim 13 wherein said winch means is rotatably mounted in said substructure.

18. The drilling derrick assembly defined in claim 17 wherein said winch means is adapted to receive motive power from an external source.

19. A drilling derrick assembly comprising:

a substructure, an elevatable floor assembly positioned generally above and supported by said substructure, an elevating means for raising said elevatable floor assembly from a lower position to an elevated position generally above said substructure, said elevating means including an elevating frame, said elevatable floor assembly including a working floor, a mast supported solely by said elevatable floor assembly and pivotal between both a cantilever reclined position while supported by said elevatable floor assembly and a raised position, and said working floor including a working floor cantilever portion extending out from said mast towards said elevating frame.

20. The drilling derrick assembly of claim 19 including, a gin pole assembly mounted to said elevatable floor assembly and to which said mast is secured when in said raised position.

21. The drilling derrick assembly of claim 20 including, at least one line reeved about said gin pole assembly and operatively connected to said mast for raising said mast.

22. The drilling derrick assembly of claim 19 including, said elevating frame being mounted on said substructure, and said working floor cantilever portion extending towards said elevating frame when said elevatable floor assembly is in said lower position.

23. The drilling derrick assembly of claim 19 including, said elevating means further including an elevating block assembly connected to said elevating frame and a winch means operatively connected to said block assembly.

24. The drilling derrick assembly of claim 19 including, a pair of brace members pivotally connected at their ends, respectively, to said substructure and to said elevatable floor assembly thereby forming a parallel linkage.

25. The drilling derrick assembly of claim 19 including, said elevating means being positioned entirely below said working floor where said elevatable floor assembly is in said elevated position.

26. The drilling derrick assembly of claim 19 including, said working floor cantilever portion being horizontally disposed when said elevatable floor assembly is in said lower position.

27. The drilling derrick assembly of claim 19 including, said elevating frame including first and second attachment points for attaching said elevating frame to said substructure, and said working floor cantilever portion, when said elevatable floor assembly is in said lower position, being disposed directly above and extending over said first attachment point.

28. The drilling derrick assembly of claim 27 including, said working floor cantilever portion when said elevatable floor assembly is in said elevated position, being disposed directly above and extending over said second attachment point.

29. The drilling derrick assembly of claim 19 including, said working floor being disposed directly above and extending over said elevating frame when said elevatable floor assembly is in said elevated position.

30. The drilling derrick assembly of claim 19 including, said working floor cantilever portion being positioned directly below said mast when said mast is in said cantilever reclined position.

31. The drilling derrick assembly of claim 19 including, said mast being pivotal between said cantilever reclined position and said raised position about a pivotal location of said elevatable floor assembly, and said working floor cantilever portion extending out from said pivotal location.

32. The drilling derrick assembly of claim 19 including, said working floor cantilever portion defining a rigging up area extending out from said mast when said elevatable floor assembly is in said lower position.

33. The drilling derrick assembly of claim 19 including, said working floor cantilever portion being horizontally disposed when said elevatable floor assembly is in said lower position, said working floor being disposed directly above and extending over said elevating frame when said elevatable floor assembly is in said elevated position, and said working floor cantilever portion being positioned directly below said mast when said mast is in said cantilever reclined position.

34. The drilling derrick assembly of claim 19 including, pivoting means secured to said elevatable floor assembly for pivoting said mast between said cantilever reclined position and said raised position.

35. A drilling derrick assembly comprising:

a substructure, an elevatable floor assembly position generally above and supported by said substructure, an elevating means for raising said elevatable floor assembly from a lower position to an elevated position generally above said substructure, said elevating means including an elevating member, said elevating member being elongated and having ends, pivot means being pivotally connected at said ends, respectively, to said substructure and to said elevatable floor assembly, elevating member mounting means secured in each of said substructure and said elevatable floor to receive said ends, said elevating member mounting means being positioned entirely between said substructure and said elevatable floor when in an elevated position and at least partially therebetween when in a lowered position, said elevatable floor assembly including a working floor, elevating mounting means secured to said elevatable floor below said working floor, said elevating means being connected to said elevating mounting means whereby said elevating means is positioned entirely below said working floor when said elevatable floor assembly is in said elevated position, a mast solely supported by said elevatable floor assembly and pivotal between both a cantilever reclined position while supported by said elevatable floor assembly and a raised position, and said working floor including a working floor cantilever portion extending out from said mast towards said elevating member.

36. The drilling derrick assembly of claim 35 including, a gin pole assembly mounted to said elevatable floor assembly and to which said mast is secured when in said raised position.

37. The drilling derrick assembly of claim 36 including, at least one line reeved about said gin pole assembly and operatively connected to said mast for raising said mast.

38. The drilling derrick assembly of claim 35 including, said elevating member including a frame mounted on said substructure, and said working floor cantilever portion extending towards said frame when said elevatable floor assembly is in said lower position.

39. The drilling derrick assembly of claim 35 including, said elevating means further including an elevating block assembly connected to said frame and a winch means operatively connected to said block assembly.

40. The drilling derrick assembly of claim 35 including said working floor cantilever portion being horizontally disposed when said elevatable floor assembly is in said lower position.

41. The drilling derrick assembly of claim 35 including, said working floor cantilever portion, when said elevatable floor assembly is in said elevated position, being disposed directly above and extending over said elevating member mounting means secured to said substructure.

42. The drilling derrick assembly of claim 35 including, said working floor cantilever portion being positioned directly below said mast when said mast is in said cantilever reclined position.

43. The drilling derrick assembly of claim 35 including, said mast being pivotal between said cantilever reclined position and said raised position about a pivotal location of said elevatable floor assembly, and said working floor cantilever portion extending out from said pivotal location.

44. The drilling derrick assembly of claim 35 including, said working floor cantilever portion defining a rigging up area extending out from said mast when said elevatable floor assembly is in said lower position.

45. The drilling derrick assembly of claim 35 including, said working floor cantilever portion being horizontally disposed when said elevatable floor assembly is in said lower position, and said working floor cantilever portion, when said elevatable floor assembly is in said elevated position, being disposed directly above and extending over said elevating member mounting means secured to said substructure.

46. The drilling derrick assembly of claim 35 including, said working floor cantilever portion being horizontally disposed when said elevatable floor assembly is in said lower position, and said working floor cantilever portion being positioned directly below said mast when said mast is in said cantilever reclined position.

47. The drilling derrick assembly of claim 35 including, said working floor cantilever portion being positioned directly below said mast when said mast is in said cantilever reclined position, said mast being pivotal between said cantilever reclined position and said raised position about a pivotal location of said elevatable floor assembly, said working floor cantilever portion extending out from said pivotal location, and said working floor cantilever portion defining a rigging up area extending out from said mast when said elevatable floor assembly is in said lower position.

48. The drilling derrick assembly of claim 35 including, said working floor cantilever portion being horizontally disposed when said elevatable floor assembly is in said lower position, said working floor cantilever portion defining a rigging up area extending out from said mast when said elevatable floor assembly is in said lower position, said working floor cantilever portion, when said elevatable floor assembly is in said elevated position, being disposed directly above and extending over said elevating member mounting means secured to said substructure, and said elevating means further including an elevating block assembly connected to said frame and a winch means operatively connected to said block assembly.

49. The drilling derrick assembly of claim 35 including, said working floor cantilever portion being horizontally disposed when said elevatable floor assembly is in said lower position, said working floor cantilever portion being positioned directly below said mast when said mast is in said cantilever reclined position, said mast being pivotal between said cantilever reclined position and said raised position about a pivotal location of said elevatable floor assembly, said working floor cantilever portion extending out from said pivotal location, said working floor cantilever portion defining a rigging up area extending out from said mast when said elevatable floor assembly is in said lower position, said working floor cantilever portion, when said elevatable floor assembly is in said elevated position, being disposed directly above and extending over said elevating member mounting means secured to said substructure, and said elevating means further including an elevating block assembly connected to said frame and a winch means operatively connected to said block assembly.

50. The drilling derrick assembly of claim 35 including, pivoting means secured to said elevatable floor assembly for pivoting said mast between said cantilever reclined position and said raised position.

51. A drilling derrick assembly comprising:

a substructure, an elevatable floor assembly positioned generally above and supported by said substructure, an elevating means for raising said elevatable floor assembly from a lower position to an elevated position generally above said substructure, a mounting means at least a portion of which is positioned vertically below said elevatable floor assembly when said elevatable floor assembly is in both said lower and elevated positions for mounting said elevating means to said substructure, a mast supported by said elevatable floor assembly and pivotal between a cantilever reclined position and a raised position, said elevating means including an elevating frame, and said elevating frame including a rearwardly extending brace member extending at least partially beneath the elevatable floor assembly, and said mounting means pivotally mounting said brace member to said substructure.

52. The drilling derrick assembly of claim 51 including, said mounting means being positioned entirely beneath said elevatable floor assembly when in said elevated position.

53. The drilling derrick assembly of claim 51 including, said elevating means being positioned to not extend above the top of said elevatable floor assembly when in an elevated position.

54. The drilling derrick assembly of claim 51 including, said mounting means for mounting said elevating means to said substructure being positioned entirely beneath said elevated floor assembly when in an elevated position, and said elevating means extending up to but below the top of said elevatable floor assembly when in said elevated position.

55. A drilling derrick assembly comprising:

a substructure, an elevatable floor assembly positioned generally above and supported by said substructure and having a unitary working floor positioned entirely horizontally, an elevating means for raising said elevatable floor assembly from a lower position to an elevated position generally above said substructure, a mounting means at least a portion of which is positioned vertically below said elevatable floor assembly when said elevatable floor assembly is in both said lower and elevated positions for mounting said elevating means to said substructure, a mast supported by said elevatable floor assembly and pivotal between a cantilever reclined position and a raised position, said elevating means including at least one elevating arm having one end thereof secured to said mounting means and maintained continuously below said elevatable floor assembly during and after elevation to said elevated position, and whereby the working floor can be entirely rigged at ground level before elevation and said elevating means provides both a compact assembly prior to elevation of said floor and a stable support for said floor thereafter.

56. The drilling derrick assembly of claim 55 including, said mounting means being positioned entirely beneath said elevatable floor assembly when in said elevated position.

57. The drilling derrick assembly of claim 55 including, said elevating means being positioned to not extend above the top of said elevatable floor assembly when in an elevated position.

58. The drilling derrick assembly of claim 55 including, said mounting means for mounting said elevating means to said substructure being positioned entirely beneath said elevatable floor assembly when in an elevated position, and said elevating means extending up to but below the top of said elevatable floor assembly when in said elevated position.

59. The drilling derrick assembly of claim 55 including, said working floor including an integral working floor cantilever portion extending out from said mast towards said mast cantilever reclined position.

60. The drilling derrick assembly of claim 59 including, said integral working floor cantilever portion also extending out from the opposite end as a cantilever.

61. The drilling derrick assembly of claim 55 including, said mounting means being positioned entirely beneath said elevatable floor assembly when in said elevated position, and said working floor including an integral working floor cantilever portion extending out from said mast towards said mast cantilever reclined position.

62. The drilling derrick assembly of claim 55 including, said elevating means being positioned to not extend above the top of said elevatable assembly when in an elevated position, and said working floor including an integral working floor cantilever portion extending out from said mast towards said mast cantilever reclined position.

63. The drilling derrick assembly of claim 55 including, said mounting means for mounting said elevating means to said substructure being positioned entirely beneath said elevatable floor assembly when in an elevated position, said elevating means extending up to but below the top of said elevatable floor assembly when in said elevated position, and said working floor including an integral working floor cantilever portion extending out from said mast towards said mast cantilever reclined position.

64. The drilling derrick assembly of claim 55 including, said mounting means for mounting said elevating means to said substructure being positioned entirely beneath said elevatable floor assembly when in an elevated position, said elevating means extending up to but below the top of said elevatable floor assembly when in said elevated position, said working floor including an integral working floor cantilever portion extending out from said mast towards said mast cantilever reclined position, and said integral working floor cantilever portion also extending out from the opposite end as a cantilever.

65. A drilling derrick assembly comprising:

a substructure, an elevatable floor having a working floor positioned generally above and supported by said substructure, an elevating means for raising said elevatable floor from a lower position to an elevated position generally above said substructure, a mast supported by said elevatable floor assembly, a pivotal connecting means for pivotally connecting said mast to said elevatable floor and about which said mast pivots between a cantilever reclined position and a raised substantially vertical position, said elevating means including an elevating frame mounted on said substructure, said elevating frame being positionable in a raised position and in a collapsed position, said elevating frame including a leg member having a first leg member end and an opposite second leg member end, and a brace member extending at least partially beneath said elevatable floor assembly when in a lower position, said brace member having a first brace member end and an opposite second brace member end, said first leg member end and said first brace member end being coupled relative to each other, said second leg member end being connected to said substructure at a leg connection point when said elevating frame is in said raised position, and said second brace member end being connected to said substructure at a brace connection point positioned vertically below said elevatable floor assembly when in a lower position and also when in an elevated position, whereby said brace member extends at least partially beneath said elevatable floor assembly in lower position to permit compact transportation and substantial stability.

66. The drilling derrick assembly of claim 65 including, said leg member being vertically disposed when said elevating frame is in said raised position.

67. The drilling derrick assembly of claim 65 including, said second brace member end being connected to said substructure at said brace connection point when said elevating frame is in said collapsed position.

68. The drilling derrick assembly of claim 65 including, said second leg member end being disconnected and spaced from said leg connection point when said elevating frame is in said collapsed position.

69. The drilling derrick assembly of claim 65 including, said leg member and said brace member being disposed generally parallel to one another when said elevating frame is in said collapsed position.

70. The drilling derrick assembly of claim 65 including, said elevating means being positioned to not extend above the top of said elevatable floor assembly when in an elevated position.

71. The drilling derrick assembly of claim 65 including, said working floor being unitary and being positioned entirely horizontal during the raising of said working floor.

72. The drilling derrick assembly of claim 65 including, said working floor including an integral working floor cantilever portion extending out from said mast towards said mast cantilever reclined position.

73. The drilling derrick assembly of claim 65 including, said integral working floor cantilever portion also extending out from the opposite end as a cantilever.

74. The drilling derrick assembly of claim 65 including, said elevating means being positioned to not extend above the top of said elevatable floor assembly when in an elevated position, and said working floor being unitary and being positioned entirely horizontal during the raising of said working floor.

75. The drilling derrick assembly of claim 65 including, said elevating means being positioned to not extend above the top of said elevatable floor assembly when in an elevated position, and said working floor including an integral working floor cantilever portion extending out from said mast towards said mast cantilever reclined position.

76. The drilling derrick assembly of claim 65 including, said elevating means being positioned to not extend above the top of said elevatable floor assembly when in an elevated position, said working floor being unitary and being positioned entirely horizontal during the raising of said working floor, and said working floor including an integral working floor cantilever portion extending out from said mast towards said mast cantilever reclined position.

77. The drilling derrick assembly of claim 65 including, said elevating means being positioned to not extend above the top of said elevatable floor assembly when in an elevated position, said working floor being unitary and being positioned entirely horizontal during the raising of said working floor, said working floor including an integral working floor cantilever portion extending out from said mast towards said mast cantilever reclined position, and said integral working floor cantilever portion also extending out from the opposite end as a cantilever.

78. The drilling derrick assembly of claim 65 including, said pivotal connecting means being secured to said elevatable floor and movable therewith from said lower position to said elevated position.

79. The drilling derrick assembly of claim 65 including, a gin pole assembly mounted to said elevatable floor and to which said mast is secured when in said raised substantially vertical position.

80. The drilling derrick assembly of claim 79 including, at least one line reeved about said gin pole assembly and operatively connected to said mast for raising said mast.

81. The drilling derrick assembly of claim 65 including, said elevating means further including an elevating block assembly connected to said elevating frame and a winch means operatively connected to said elevating block assembly.

82. The drilling derrick assembly of claim 65 including, a pair of elongated members pivotally connected at their ends, respectively, to said substructure and to said elevatable floor thereby forming a parallel linkage.

83. A drilling derrick assembly comprising:

a substructure, an elevatable floor assembly positioned generally above and supported by said substructure, an elevating means for raising said elevatable floor assembly from a lower position to an elevated position generally above aaid substructure, said elevating means including an elevating frame, said elevatable floor assembly including a working floor, a mast supported by said elevatable floor assembly and pivotal between a cantilever reclined position and a raised position, said working floor including a working floor cantilever portion extending out from said mast towards said elevating frame, said elevating frame including first and second attachment points for attaching said elevating frame to said substructure, and said working floor cantilever portion, when said elevatable floor assembly is in said lower position, being disposed directly above and extending over said first attachment point.

84. A drilling derrick assembly comprising:

a substructure, an elevatable floor assembly positioned generally above and supported by said substructure, an elevating means for raising said elevatable floor assembly from a lower position to an elevated position generally above said substructure, said elevating means including an elevating frame, said elevatable floor assembly including a working floor, a mast supported by said elevatable floor assembly and pivotal between a cantilever reclined position and a raised position, said working floor including a working floor cantilever portion extending out from said mast towards said elevating frame, and said working floor being disposed directly above and extending over said elevating frame when said elevatable floor assembly is in said elevated position.

85. A drilling derrick assembly comprising:

a substructure, an elevatable floor assembly positioned generally above and supported by said substructure, an elevating means for raising said elevatable floor assembly from a lower position to an elevated position generally above said substructure, said elevating means including an elevating frame, said elevatable floor assembly including a working floor, a mast supported by said elevatable floor assembly and pivotal between a cantilever reclined position and a raised position, said working floor including a working floor cantilever portion extending out from said mast towards said elevating frame, and said working floor cantilever portion being positioned directly below said mast when said mast is in said cantilever reclined position.

86. A drilling derrick assembly comprising:

a substructure, an elevatable floor assembly positioned generally above and supported by said substructure, an elevating means for raising said elevatable floor assembly from a lower position to an elevated position generally above said substructure, said elevating means including an elevating frame, said elevatable floor assembly including a working floor, a mast supported by said elevatable floor assembly and pivotal between a cantilever reclined position and a raised position, said working floor including a working floor cantilever portion extending out from said mast towards said elevating frame, said mast being pivotal between said cantilever reclined position and said raised position about a pivotal location of said elevatable floor assembly, and said working floor cantilever portion extending out from said pivotal location.

87. A drilling derrick assembly comprising:

a substructure, an elevatable floor assembly positioned generally above and supported by said substructure, an elevating means for raising said elevatable floor assembly from a lower position to an elevated position generally above said substructure, said elevating means including an elevating frame, said elevatable floor assembly including a work floor, a mast supported by said elevatable floor assembly and pivotal between a cantilever reclined position and a raised position, said working floor including a working floor cantilever portion extending out from said mast towards said elevating frame, said working floor cantilever portion being horizontally disposed when said elevatable floor assembly is in said lower position, said working floor being disposed directly above and extending over said elevating frame when said elevatable floor assembly is in said elevated position, and said working floor cantilever portion being positioned directly below said mast when said mast is in said cantilever reclined position.

88. A drilling derrick assembly comprising:

a substructure, an elevatable floor assembly positioned generally above and supported by said substructure, an elevating means for raising said elevatable floor assembly from a lower position to an elevated position generally above said substructure, said elevating means including an elevating member, said elevating member being elongated and having ends, pivot means being pivotally connected at said ends, respectively, to said substructure and to said elevatable floor assembly, elevating member mounting means secured in each of said substructure and said elevatable floor to receive said ends, said elevating member mounting means being positioned entirely between said substructure and said elevatable floor when in an elevated position and at least partially therebetween when in a lowered position, said elevatable floor assembly including a working floor, elevating mounting means secured to said elevatable floor below said working floor, said elevating means being connected to said elevating mounting means whereby said elevating means is positioned entirely below said working floor when said elevatable floor assembly is in said elevated position, a mast supported by said elevatable floor assembly and pivotal between a cantilever reclined position and a raised position, said working floor including a working floor cantilever portion extending out from said mast towards said elevating frame, and said working floor cantilever portion being positioned directly below said mast when said mast is in said cantilever reclined position.

89. The drilling derrick of claim 88 including, said working floor cantilever portion, when said elevatable floor assembly is in said elevated position, being disposed directly above and extending over said elevating member mounting means secured to said substructure.

90. A drilling derrick assembly comprising:

a substructure, an elevatable floor assembly positioned generally above and supported by said substructure, an elevating means for raising said elevatable floor assembly from a lower position to an elevated position generally above said substructure, said elevating means including an elevating member, said elevating member being elongated and having ends, pivot means being pivotally connected at said ends, respectively, to said substructure and to said elevatable floor assembly, elevating member mounting means secured in each of said substructure and said elevatable floor to receive said ends, said elevating member mounting means being positioned entirely between said substructure and said elevatable floor when in an elevated position and at least partially therebetween when in a lowered position, said elevatable floor assembly including a working floor, elevating mounting means secured to said elevatable floor below said working floor, said elevating means being connected to said elevating mounting means whereby said elevating means is positioned entirely below said working floor when said elevatable floor assembly is in said elevated position, a mast supported by said elevatable floor assembly and pivotal between a cantilever reclined position and a raised position, said working floor including a working floor cantilever portion extending out from said mast towards said elevating frame, said mast being pivotal between said cantilever reclined position and said raised position about a pivotal location of said elevatable floor assembly, and said working floor cantilever portion extending out from said pivotal location.

91. A drilling derrick assembly comprising:

a substructure, an elevatable floor assembly positioned generally above and supported by said substructure, an elevating means for raising said elevatable floor assembly from a lower position to an elevated position generally above said substructure, said elevating means including an elevating member, said elevating member being elongated and having ends, pivot means being pivotally connected at said ends, respectively, to said substructure and to said elevatable floor assembly, elevating member mounting means secured in each of said substructure and said elevatable floor to receive said ends, said elevating member mounting means being positioned entirely between said substructure and said elevatable floor when in an elevated position and at least partially therebetween when in a lowered position, said elevatable floor assembly including a working floor, elevating mounting means secured to said elevatable floor below said working floor, said elevating means being connected to said elevating mounting means whereby said elevating means is positioned entirely below said working floor when said elevatable floor assembly is in said elevated position, a mast supported by said elevatable floor assembly and pivotal between a cantilever reclined position and a raised position, said working floor including a working floor cantilever portion extending out from said mast towards said elevating frame, and said working floor cantilever portion defining a rigging up area extending out from said mast when said elevatable floor assembly is in said lower position.

92. A drilling derrick assembly comprising:

a substructure, an elevatable floor assembly positioned generally above and supported by said substructure, an elevating means for raising said elevatable floor assembly from a lower position to an elevated position generally above said substructure, said elevating means including an elevating member, said elevating member being elongated and having ends, pivot means being pivotally connected at said ends, respectively, to said substructure and to said elevatable floor assembly, elevating member mounting means secured in each of said substructure and said elevatable floor to receive said ends, said elevating member mounting means being positioned entirely between said substructure and said elevatable floor when in an elevated position and at least partially therebetween when in a lowered position, said elevatable floor assembly including a working floor, elevating mounting means secured to said elevatable floor below said working floor, said elevating means being connected to said elevating mounting means whereby said elevating means is positioned entirely below said working floor when said elevatable floor assembly is in said elevated position, a mast supported by said elevatable floor assembly and pivotal between a cantilever reclined position and a raised position, said working floor including a working floor cantilever portion extending out from said mast towards said elevating frame, said working floor cantilever portion being horizontally disposed when said elevatable floor assembly is in said lower position, and said working floor cantilever portion being positioned directly below said mast when said mast is in said cantilever reclined position.

93. A drilling derrick assembly comprising:

a substructure an elevatable floor assembly positioned generally above and supported by said substructure, an elevating means for raising said elevatable floor assembly from a lower position to an elevated position generally above said substructure, said elevating means including an elevating member, said elevating member being elongated and having ends, pivot means being pivotally connected at said ends, respectively, to said substructure and to said elevatable floor assembly, elevating member mounting means secured in each of said substructure and said elevatable floor to receive said ends, said elevating member mounting means being positioned entirely between said substructure and said elevatable floor when in an elevated position and at least partially therebetween when in a lowered position, said elevatable floor assembly including a working floor, elevating mounting means secured to said elevatable floor below said working floor, said elevating means being connected to said elevating mounting means whereby said elevating means is positioned entirely below said working floor when said elevatable floor assembly is in said elevated position, a mast supported by said elevatable floor assembly and pivotal between a cantilever reclined position and a raised position, said working floor including a working floor cantilever portion extending out from said mast towards said elevating frame, said working floor cantilever portion being positioned directly below said mast when said mast is in said cantilever reclined position, said mast being pivotal between said cantilever reclined position and said raised position about a pivotal location of said elevatable floor assembly, said working floor cantilever portion extending out from said pivotal location, and said working floor cantilever portion defining a rigging up area extending out from said mast when said elevatable floor assembly is in said lower position.

94. A drilling derrick assembly comprising:

a substructure, an elevatable floor assembly positioned generally above and supported by said substructure, an elevating means for raising said elevatable floor assembly from a lower position to an elevated position generally above said substructure, said elevating means including an elevating member, said elevating member being elongated and having ends, pivot means being pivotally connected at said ends, respectively, to said substructure and to said elevatable floor assembly, elevating member mounting means secured in each of said substructure and said elevatable floor to receive said ends, said elevating member mounting means being positioned entirely between said substructure and said elevatable floor when in an elevated position and at least partially therebetween when in a lowered position, said elevatable floor assembly including a working floor, elevating mounting means secured to said elevatable floor below said working floor, said elevating means being connected to said elevating mounting means whereby said elevating means is positioned entirely below said working floor when said elevatable floor assembly is in said elevated position, a mast supported by said elevatable floor assembly and pivotal between a cantilever reclined position and a raised position, said working floor including a working floor cantilever portion extending out from said mast towards said elevating frame, said working floor cantilever portion being horizontally disposed when said elevatable floor assembly is in said lower position, said working floor cantilever portion defining a rigging up area extending out from said mast when said elevatable floor assembly is in said lower position, said working floor cantilever position, when said elevatable floor assembly is in said elevated position, being disposed directly above and extending over said elevating member mounting means secured to said substructure, and said elevating means further including an elevating block assembly connected to said frame and a winch means operatively connected to said block assembly.

95. A drilling derrick assembly comprising:

a substructure, an elevatable floor assembly positioned generally above and supported by said substructure, an elevating means for raising said elevatable floor assembly from a lower position to an elevated position generally above said substructure, said elevating means including an elevating member, said elevating member being elongated and having ends, pivot means being pivotally connected at said ends, respectively, to said substructure and to said elevatable floor assembly, elevating member mounting means secured in each of said substructure and said elevatable floor to receive said ends, said elevating member mounting means being positioned entirely between said substructure and said elevatable floor when in an elevated position and at least partially therebetween when in a lowered position, said elevatable floor assembly including a working floor, elevating mounting means secured to said elevatable floor below said working floor, said elevating means being connected to said elevating mounting means whereby said elevating means is positioned entirely below said working floor when said elevatable floor assembly is in said elevated position, a mast supported by said elevatable floor assembly and pivotal between a cantilever reclined position and a raised position, said working floor including a working floor cantilever portion extending out from said mast towards said elevating frame, said working floor cantilever portion being horizontally disposed when said elevatable floor assembly is in said lower position, said working floor cantilever portion being positioned directly below said mast when said mast is in said cantilever reclined position, said mast being pivotal between said cantilever reclined position and said raised position about a pivotal location of said elevatable floor assembly, said working floor cantilever portion extending out from said pivotal location, said working floor cantilever portion defining a rigging up area extending out from said mast when said elevatable floor assembly is in said lower position, said working floor cantilever portion, when said elevatable floor assembly is in said elevated position, being disposed directly above and extending over said elevating member mounting means secured to said substructure, and said elevating means further including an elevating block assembly connected to said frame and a winch means operatively connected to said block assembly.

* * * * *

UNITED STATES PATENT AND TRADEMARK OFFICE

CERTIFICATE OF CORRECTION

PATENT NO. : 4,831,795

DATED : May 23, 1989

INVENTOR(S) : Ronald S. Sorokan

It is certified that error appears in the above-identified patent and that said Letters Patent is hereby corrected as shown below:

On the cover page of the patent, under the title "Related U.S. Application Data", please delete the period at the end of the sentence and add the following:

, which is a continuation of Ser. No. 201,619, filed October 28, 1980.

Signed and Sealed this

Thirteenth Day of March, 1990

*Attest:*

JEFFREY M. SAMUELS

*Attesting Officer*

*Acting Commissioner of Patents and Trademarks*